United States Patent [19]

Marks

[11] Patent Number: 4,767,287

[45] Date of Patent: Aug. 30, 1988

[54] RECIPROCATING PISTON MECHANISM

[75] Inventor: David T. Marks, Birmingham, Mich.

[73] Assignee: Institute of Gas Technology, Chicago, Ill.

[21] Appl. No.: 801,590

[22] Filed: Nov. 25, 1985

[51] Int. Cl.[4] ..... F02B 59/00

[52] U.S. Cl. ..... 417/461; 123/42; 417/488

[58] Field of Search ..... 417/461, 488; 418/88; 123/42

[56] References Cited

U.S. PATENT DOCUMENTS

| | | | |
|---|---|---|---|
| 628,124 | 7/1899 | Sharpneck | 123/42 |
| 963,676 | 7/1910 | Wright | 417/488 |
| 1,689,419 | 10/1928 | Bronandes | 417/488 |
| 2,535,308 | 12/1950 | Mansted | 417/488 X |
| 2,673,519 | 3/1954 | Halliburton | 417/488 X |
| 2,867,375 | 1/1959 | Petersen | 417/488 X |
| 3,649,204 | 3/1972 | Farr | 417/488 X |
| 4,375,945 | 3/1983 | Jarret et al. | 417/488 X |

FOREIGN PATENT DOCUMENTS

| | | | |
|---|---|---|---|
| 2026612 | 2/1980 | United Kingdom | 418/88 |

*Primary Examiner*—Carlton R. Croyle
*Assistant Examiner*—Theodore Olds
*Attorney, Agent, or Firm*—Thomas W. Speckman

[57] ABSTRACT

A reciprocating opposed piston mechanism having at least one cylinder assembly mounted to oscillate in rotary relation to a block about a central axis, two opposing pistons reciprocally mounted within the cylinder, each of the pistons having an eccentric bearing mounted in its rear portion with an eccentric rotatably mounted in each eccentric bearing, each eccentric fixedly mounted to an eccentric shaft. Each eccentric shaft is mounted to the engine block and rotatable about an eccentric shaft axis equally spaced in opposite directions from the central cylinder oscillation axis. Timing mechanisms in force transmission relation to each of the eccentric shafts is provided to maintain the eccentrics in each cylinder assembly 180° out of rotary phase. An even number of such cylinder assemblies, adjacently 180° out of phase, may be assembled to form the mechanism of this invention. The mechanism is useful as an internal or external combustion engine, compressor or prime mover.

24 Claims, 2 Drawing Sheets

RECIPROCATING PISTON MECHANISM

BACKGROUND OF THE INVENTION

1. Field of the Invention

This invention relates to opposed reciprocating piston mechanisms such as internal combustion engines and compressors. The use of shaft eccentrics in combination with pivotally mounted cylinders provides uniflow scavenging through the cylinder with significant reduction in combustion chamber and crankcase sealing requirements.

2. Description of the Prior Art

The primary cause for limited application of the two-stroke cycle engine to commercial use, is related to cylinder air/fuel charge and exhaust problems causing substantial decrease in the actual Mean Effective Pressure (MEP) and the related efficiency of two-stroke engines. It is the cylinder scavenging system which determines the quality of the cylinder charge exchange process.

Efforts to improve scavenging systems have focused primarily on the development of internal crankcase scavenging. These have lead to considerable complexity in crankcase design, the requirement for additional mechanical working components, sealing and lubrication problems in regions in close proximity to the combustion and crankcase chambers, and has added to the cost to manufacture, operate and maintain this type of internal scavenging two-cycle engine.

It is known to the art that the most effective scavenging system is of uniflow design, wherein inlet and exhaust ports are symmetrically positioned at opposite ends of the cylinder to provide a direct flow of charge reactants and exhaust products through the cylinder and wherein the pressure to accomplish such scavenging is generated through the use of an external blower.

As generally disclosed in the prior art, many of the reciprocating piston mechanisms require one or more intermediate power transmissions to transmit power to or from a piston and a drive shaft. In an engine, power is conventionally transmitted from the piston to the connecting rod, then power is transmitted from the connecting rod to the crankshaft which in turn transmits power to a power take-off shaft. The reverse pathway is generally used when the reciprocating piston mechanism is used as a compressor. Use of a connecting rod results in uneven and excessive wear to both the piston and cylinder wall by vectors of force through the connecting rod in directions other than along the centerline axis of the cylinder. When the piston is in any position, other than its top dead center or bottom dead center, transverse, lateral force vectors will be transmitted by the connecting rod causing uneven wear to the piston and cylinder wall.

In recent years various efforts have been made to depart from the conventional engine utilizing reciprocating pistons and stationary cylinders to provide generally improved engine balancing and power output by elimination of connecting rods. Efforts have been made to improve engine balancing and efficiency through development of rotary piston engines such as taught by U.S. Pat. Nos. 3,974,803 and 4,010,675 having rotary movable piston and cylinder piston elements which both rotate within a staionary body forming two variable volume chambers, one of which may serve as a combustion or compression chamber and the other as a precompression chamber. U.S. Pat. No. 3,630,178 teaches a mechanism in which the motion of a working piston is circular and a migrating combustion chamber member forming a pair of combustion chambers. Two additional variable volume chambers are formed between a power block housing and the combustion chamber member for assistance in intake charging and exhaust.

U.S. Pat. No. 3,621,758 teaches a reciprocating piston, pivotally oscillating cylinder internal combustion machine to provide improved aspirating capacity in substantial excess of the displacement of the piston per cycle. In one embodiment, opposed pistons reciprocate in a cylinder mounted to a pivotal platen. Each piston is connected directly to a crankshaft and the end of the piston opposite to the combustion chamber engages a crankcase surface and in cooperation with crankshaft webs provide more complete expansion of working fluid into the crankcase and internal crankcase scavenging. The machine of the '758 patent requires undesirable bearing and frictional surfaces between co-working elements, including the rear end of the pistons and the crankcase housing and between the pivotal platen around the cylinder and the engine block housing. These result in sealing problems and may diminish the useful life of the machine. In addition, the pivotal platen housing the cylinder is of considerable mass and significantly increases the weight of the engine as well as introducing polar inertia considerations.

SUMMARY OF THE INVENTION

The present invention is a significant simplification over prior art piston mechanisms in that the conventional connecting rod and its complex crankshaft are both eliminated as a means to transmit power to or from a piston, simplified sealing results from design characteristics, and uniflow scavenging of the cylinder volume is provided.

In the reciprocating piston mechanism of this invention two opposing pistons reciprocate along the axis of a single cylinder, the variable volume between the opposing faces of the pistons being the compression and expansion volume. While the term "cylinder" is used throughout the disclosure and claims, it should be understood that the cross section of the piston and cylinder at 90° to their longitudinal axis may be round, oval, rectangular, square, or any other shape symmetrical with the longitudinal axis. Round is a preferred shape permitting use of conventional sealing rings. The opposing pistons reciprocate within the cylinder by action of eccentrics each rotatably mounted and in force transmission relation to its respective piston. The eccentrics are each non-rotatably mounted upon an eccentric shaft which is rotatable in fixed position with respect to oscillation of the cylinder about an oscillation axis through the centerline of the cylinder at a position midway between the opposing faces of the pistons. The axis of each of the eccentric shafts and the pivotal axis of the cylinder are located on the centerline of the cylinder in the dead center close position and in the dead center spaced position of the opposing pistons. Rotation of the two eccentric shafts in the same direction produces matched reciprocation of the opposing pistons concurrently with oscillation of the cylinder about its oscillation axis. Rotary oscillation of the cylinder obviates the lateral component vectors between the piston and cylinder wall resulting from the gaseous force acting upon the piston while applying that force only along the centerline of the opposed reciprocating pistons. Timing to maintain opposed eccentrics at 180° rotary relation to each other is achieved by a suitable timing mechanism operating between the two eccentric shafts. Suitable openings are provided through the cylinder wall in the region between the two pistons in dead center close position for fuel intake in an engine or for compressed fluid output in a compressor. Suitable openings are also provided through the cylinder wall in the region adjacent each piston in the dead center spaced position for exhaust and uniflow scavenging in an engine or for working fluid input in a compressor.

Similar opposed reciprocating piston cylinder assemblies may be joined in even numbered pairs and arranged in alternate cyclic operation by adjacent eccentrics being positioned 180° apart on a single eccentric shaft.

Sealing required for the reciprocating piston machine of this invention may be easily achieved by utilization of conventional piston ring seals located in the periphery of the pistons and sealing against the cylinder walls when the piston and cylinder cross sections are round. When the cross sections are polygonal, bar seals may be used. The crankcase of the opposed reciprocating piston machine of this invention may be of lightweight construction and lubrication of eccentric and eccentric shaft bearings may be provided by conventional lubrication techniques, such as pump pressurized lubrication.

It is an object of this invention to provide an opposed piston reciprocating mechanism wherein force is transmitted between the piston and eccentric shafts by eccentrics each rotatably mounted with respect to its respective piston and wherein each cylinder housing a pair of opposed reciprocating pistons pivotally oscillates about an axis symmetrically located with respect to the two pistons and together with the axis of each eccentric shaft is located on the centerline of the cylinder in the dead center close piston position and in the dead center spaced piston position.

It is another object of this invention to provide an opposed reciprocating piston mechanism having uniflow scavenging.

It is still another object of this invention to provide an opposed piston reciprocating mechanism with an even number of pivotally oscillating cylinders in oppositely phased relation with respect to pivotal oscillation resulting in a dynamically balanced reciprocating piston mechanism.

BRIEF DESCRIPTION OF THE DRAWING

The above and other features of this invention will be best understood by reference to the following Description of Preferred Embodiments of the invention taken in conjunction with the accompanying drawing in which.

DESCRIPTION OF PREFERRED EMBODIMENTS

For purposes of illustration only, the embodiments described in detail herein are with reference to a two-stroke compression ignition internal combustion engine. It will be apparent that the embodiments disclosed herein are equally applicable to other forms of reciprocating piston mechanisms such as compressors, spark ignition internal combustion engines, external combustion engines, steam engines or steam expanders, prime movers, pumps and other cyclic pressure fluid mechanisms.

Figure 1:
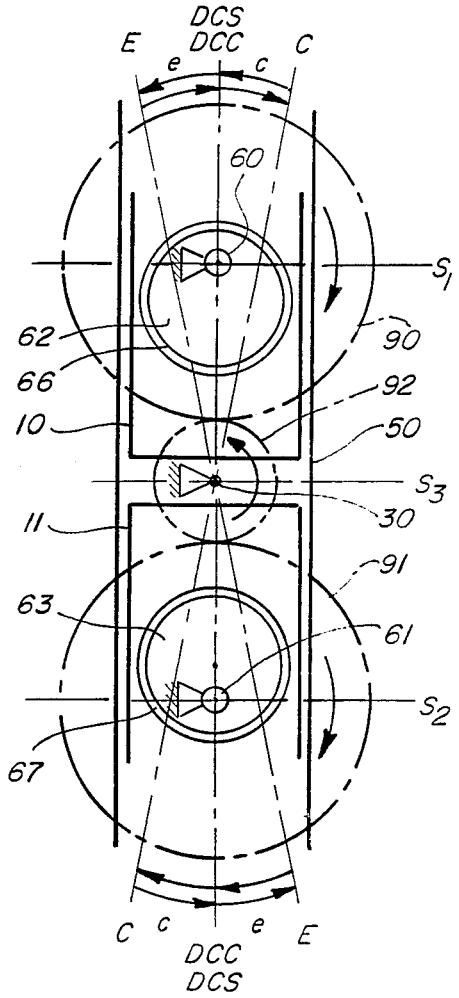
FIG. 1 schematically shows a reciprocating piston mechanism of this invention with pistons in the dead center close position.

FIG. 1 schematically shows an opposed reciprocating piston mechanism of this invention in the dead center close position. As shown in FIG. 1, cylinder 50 oscillates about cylinder oscillation pivot 30 in sequence through positions represented by cylinder center lines DCC—DCC (Dead Center Close) to E—E (Expansion Midpoint) to DCS—DCS (Dead Center Spaced) in an expansion phase and to C—C (Compression Midpoint) to DCC—DCC in a compression phase. The expansion phase is shown by oscillation arrows e and the compression phase shown by oscillation arrows c. Opposing pistons 10 and 11 reciprocate within cylinder 50 by action of eccentrics 62 and 63, respectively, which each rotate in a clockwise direction as shown, each rotatably mounted with respect to its respective piston (10, 11) with eccentric bearing (66, 67), respectively. Eccentrics 62 and 63 are each non-rotatably mounted upon an eccentric shaft 60 and 61, respectively, each of which is parallel to the other and rotatable about axis $S_1$ and $S_2$ which are in fixed position with respect to oscillation of the cylinder. To assure timing of the mechanism timing gear 90 is non-rotatably mounted to eccentric shaft 60, timing gear 91 is non-rotatably mounted to eccentric shaft 61. Timing gears 90 and 91 are interconnected by idler gear 92 rotatably mounted about cylinder oscillation pivot 30 on axis $S_3$.

Figure 2:
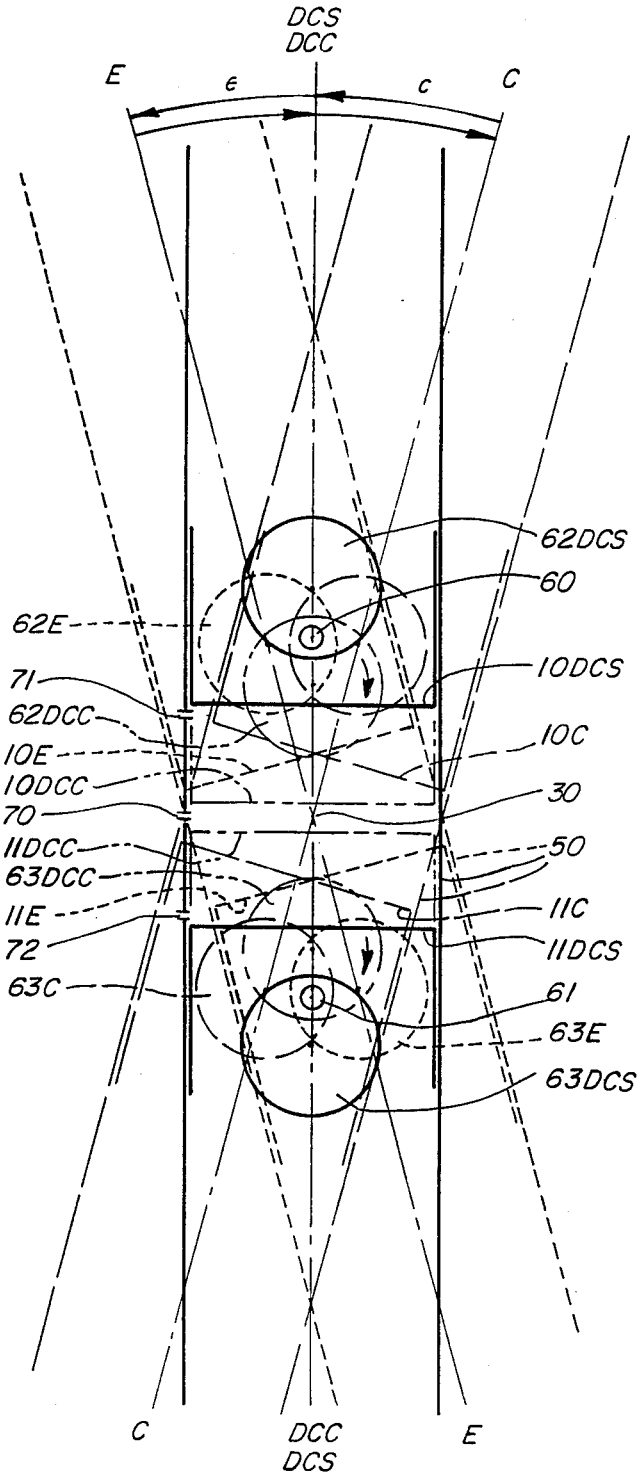
FIG. 2 schematically shows the kinematic operation of a reciprocating piston mechanism according to this invention.

In FIG. 2, the kinematic operation of an opposed reciprocating piston mechanism of this invention is shown wherein at the Dead Center Close position piston 10 DCC is shown with its eccentric 62 DCC and piston 11 DCC with its eccentric 63 DCC, the axis of cylinder 50 being shown by center line DCC—DCC. At the midway position of the expansion phase piston 10 E is shown with its eccentric 62 E and piston 11 E with its eccentric 62 E, the axis of cylinder 50 being shown by center line E—E. Center line E—E is at its highest angle of pivot e from centerline DCC—DCC in one direction of oscillation. In the full expansion position of Dead Center Spaced, piston 10 DCS is shown with its eccentric 62 DCS and piston 11 DCS with its eccentric 63 DCS, the axis of cylinder 50 being shown by center line DCS—DCS. At the midway position of the compression phase, piston 10 C is shown with its eccentric 62 C and piston 11 C with its eccentric 63 C, the axis of cylinder 50 being shown by center line C—C. Center line C—C is at its highest angle of pivot c from center line DCC—DCC in the second direction of oscillation, with angle e equal to angle c. The mechanism then returns to the Dead Center Close position. The cycle may be repeated. Openings through the cylinder wall are provided as opening 70 in the central region between pistons 10 and 11 in Dead Center Close position for fuel intake in an engine or for compressed fluid output in a compressor; and opening 71 in one end region adjacent piston 10 in the Dead Center Spaced position and opening 72 in the opposite end region adjacent piston 11 in the Dead Center Spaced position for exhaust and uniflow scavenging in an engine or for working fluid input in a compressor.

To achieve dynamic balance of the reciprocating piston mechanism, opposed reciprocating piston units as shown in FIG. 2 are joined in even numbered pairs, 2, 4, 6, etc., arranged in alternate cyclic operation which is achieved by adjacent eccentrics being positioned 180° from each other on a single eccentric shaft. Opposed positioning, or timing, of the two eccentric shafts is achieved by timing communication between the two eccentric shafts, such as by gearing.

Figure 3:
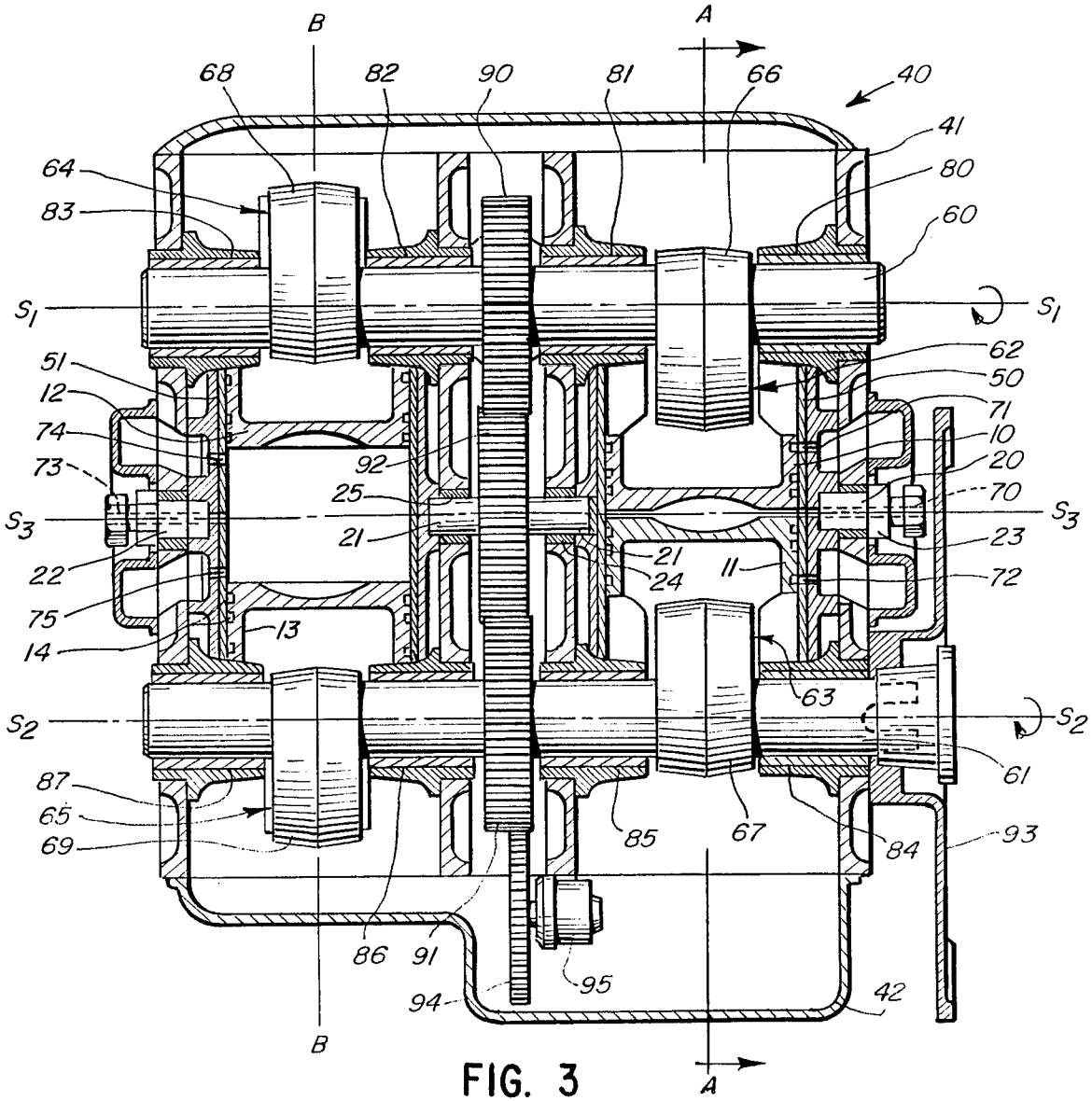
FIG. 3 shows a longitudinal sectional side view of a four piston mechanism according to one embodiment of this invention.
Figure 4:
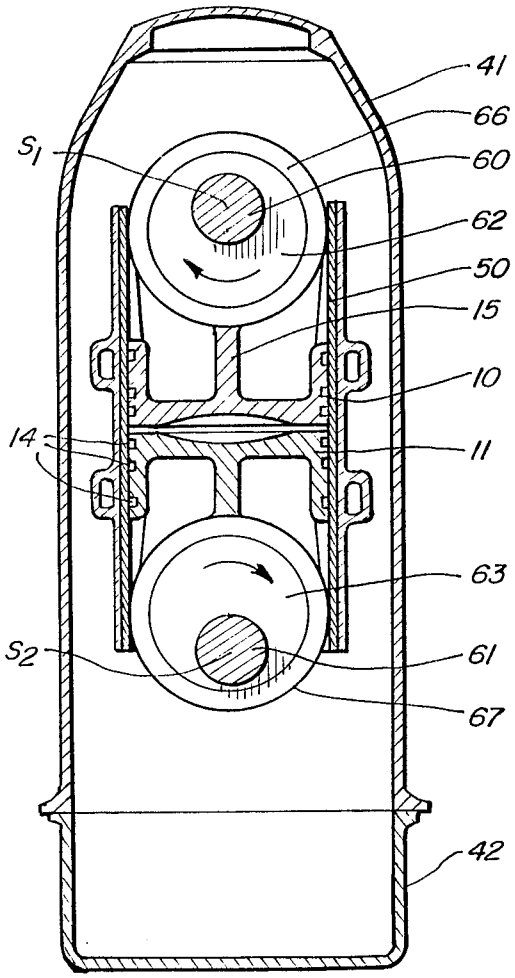
FIG. 4 shows a cross-sectional view through section A—A shown in FIG. 3.

In FIG. 3, an opposed piston reciprocating compression ignition two-stroke two cylinder internal combustion engine is shown as 40. FIG. 4 is a cross section through axis A—A as shown in FIG. 3. Engine block 41 houses individual pivotally oscillating cylinders 50 and 51. Opposed pistons 10 and 11 reciprocate along the axis A—A of cylinder 50 and opposed pistons 12 and 13 reciprocate along axis B—B of cylinder 51.

Parallel eccentric shafts 60 and 61 carry fixed eccentrics 62, 63 and 64, 65, respectively, spaced to be centered on axis A—A and B—B, respectively. The eccentrics are identically shaped and attached non-rotatably to the eccentric shafts by any suitable means. Adjacent eccentrics are arranged on the eccentric shaft at 180° from each other. Eccentric shafts 60 and 61 are rotatably mounted in eccentric shaft bearings 80, 81, 82, 83; 84, 85, 86, 87, respectively, in engine block 41. Eccentric shaft 60 rotates about axis $S_1$ and eccentric shaft 61 rotates about axis $S_2$ in the same direction. Axis $S_1$ and axis $S_2$ are equidistant from trunnion axis $S_3$. The eccentric shaft bearings may be any suitable bearings as will be readily known to one skilled in the art upon reading this description.

Eccentrics 62, 63, 64, 65 are rotatably mounted within eccentric bearings 66, 67, 68, 69, respectively. Eccentric bearings 66, 67, 68, 69 are fixidly mounted to the rear portions of pistons 10, 11, 12, 13, respectively, to allow rotation of each eccentric within its eccentric bearing. Rotation of the eccentric within its bearing fixed to the rear of the piston causes reciprocation of the piston within the cylinder. Sealing between the piston and the cylinder may be achieved by conventional piston rings 14. To achieve lightweight pistons, the pistons may have hollow rear portions with mounting of the eccentric bearings supported by web 15. Lightweight materials may be used and piston end faces may be protected by linings, such as ceramics. Likewise, the cylinders may be of lightweight material and lined with any material as well known in the art as suitable. Eccentric bearings may be any suitable bearings as will be apparent upon reading this disclosure.

Cylinders 50 and 51 are pivotally mounted in engine block 41 by trunnions 20, 21 and 21, 22, respectively. The trunnions rotate in bearings 23, 24, 25, 26 in engine block 41 to provide the oscillatory pivotal movement of the cylinders about trunnion axis $S_3$. Axis $S_3$ of the cylinder trunnions and axes $S_1$ and $S_2$ of the eccentric shafts are all on the centerline of the cylinder in Dead Center Close and Dead Center Spaced positions and remain in fixed position with respect to engine block 41 upon rotary oscillation of cylinders 50 and 51 about their respective trunnions. Trunnions 20 and 22 may advantageously enclose fuel injection ports 70 and 73, respectively. Details of the fuel injection mechanism is not shown as any suitable fuel injection system may be used. In instances where the mechanism is used for other purposes, ports 70 and 73 may be used as inlets for pressurized fluid when used as an external combustion engine, or as outlets for compressed fluid when used as a pump. Likewise, ignition systems for an internal combustion engine are not shown. Suitable valving for ports 70 and 73 is also readily apparent and may be used as required.

Synchronization of rotation of eccentric shaft 50 with respect to eccentric shaft 51 is maintained by the use of timing gear 90 keyed to eccentric shaft 60 and timing gear 91 keyed to eccentric shaft 61, both engaging idler gear 92 which rotates on trunnion 21. Idler gear 92 may also serve to transfer energy from one eccentric shaft, 60, to the other eccentric shaft, 61, so that a single power take-off, in the form of flywheel 93 non-rotatably attached to eccentric shaft 61 may be used. Likewise, similar gears, or other force transmitting means, may be used to transmit force from a single force input source.

Oil pump 95 may be driven by timing gear 91, through oil pump gear 94. Lubrication to working members of the mechanism may be provided by conventional oil channel and porting means by oil pump 95 in crankcase 42.

Opening 71 is provided through cylinder wall 50 at one end and opening 72 at the opposite end in the region adjacent each piston in the dead center spaced position. These openings may be suitably used for exhaust and uniflow scavenging in an engine or for working fluid input in a compressor. These openings may be valved or operate as ports by the oscillatory action of the cylinder. Openings 71 and 72 are provided with a suitable manifolding system to a supply or exhaust outlet. Openings 71 and 72 in cylinder wall 50 may be automatically opened and closed by oscillatory movement of the cylinder with respect to the engine block 41. Sizing, shaping and placement of the opening through the cylinder wall relative to the corresponding opening in the stationary engine block may provide desired timing of opening and closing and duration of open period as desired. The configuration of the mechanism of this invention provides that uniflow scavenging powered by an external blower, not shown, may be used by use of openings 71 and 72 to provide a sweeping action of active cylinder volume. In operation, as the opposing pistons reach about 70 to 80 percent of the expansion stroke, the ports at opposite ends of the cylinder open facilitating the direct through flow of fluid generally eliminating "dead spots" and complicated sealing associated with other scavenging systems.

The mechanism shown in FIG. 3 is a two cylinder, four piston machine. It is seen that adjacent eccentrics 62, 64 and 63, 65 are mounted on their eccentric shafts in 180° rotary relation to each other. Any even number of cylinder assemblies may have their pistons rotatably mounted to eccentrics on two eccentric shafts in this relationship. The multi-cylinder mechanism of this invention using eccentrics to transmit force to or from opposing reciprocating pistons in cylinders which are in opposed pivotal oscillation of an adjacent cylinder provides a symmetrically balanced mechanism, a mechanism utilizing a reduced number and conventional type seals, and a mechanism in which simple and effective uniflow scavenging may be used.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A process for uniflow scavenging of an internal combustion engine of the type comprising a cylinder symmetrical about a central longitudinal cylinder axis and having a trunnion means extending outwardly at its midpoint along a trunnion axis which intersects said cylinder axis at a 90° angle, said cylinder mounted by said trunnion means to said block to oscillate in rotary relation about said trunnion axis, two opposing pistons having opposing faces equidistant from said trunnion axis and reciprocally mounted with a cylinder chamber of said cylinder, each of said pistons having an eccentric bearing means mounted in its rear portion, an identical eccentric rotatably mounted in each said eccentric bearing means, each said eccentric fixedly mounted to an eccentric shaft, each said eccentric shaft rotatably mounted to said block and rotatable about an eccentric shaft axis parallel to and equally spaced in opposite directions from said trunnion axis, said eccentric shaft axes and said trunnion axis located on said cylinder axial center line when said positions are in Dead Center Close and Dead Center Spaced positions, at least one central through port through the wall of said cylinder in the region between the faces of said pistons in said Dead Center Close position providing a fuel input communication to the central portion of said cylinder chamber from the exterior of said mechanism, and end through ports through the wall of said cylinder in opposite end regions adjacent the face of each said piston in said Dead Center Spaced position providing exhaust flow communication from opposite end portions of said cylinder chamber to the exterior of said mechanism; said process comprising: passing scavenging gas through said at least one central through port to said central portion of said cylinder chamber and removing exhaust through said end through ports in said opposite end regions of said cylinder chamber, thereby providing uniflow scavenging directly from said cylinder chamber to the exterior of said mechanism during exhaust cycles.

2. A process for uniflow scavenging according to claim 1 wherein said process comprises passing said scavenging gas through a through port in said trunnion means to said central portion of said cylinder chamber.

3. In a reciprocating opposed piston mechanism having a block housing at least one cylinder assembly, said cylinder assembly comprising: a cylinder symmetrical about a central longitudinal cylinder axis and having a trunnion means extending outwardly at its midpoint along a trunnion axis which intersects said cylinder axis at a 90° angle, said cylinder mounted by said trunnion means to said block to oscillate in rotary relation about said trunnion axis, two opposing pistons having opposing faces equidistant from said trunnion axis and reciprocally mounted within a cylinder chamber of said cylinder, each of said pistons having an eccentric bearing means mounted in its rear portion, an identical eccentric rotatably mounted in each said eccentric bearing means, each said eccentric fixedly mounted to an eccentric shaft, each said eccentric shaft rotatably mounted to said block and rotatable about an eccentric shaft axis parallel to and equally spaced in opposite directions from said trunnion axis, said eccentric shaft axes and said trunnion axis located on said cylinder axial center line when said pistons are in Dead Center Close and Dead Center Spaced positions, at least one central through port through the wall of said cylinder in the region between the faces of said pistons in said Dead Center Close position providing a first fluid flow communication to and from the central portion of said cylinder chamber to the exterior of said mechanism, end through ports through the wall of said cylinder in opposite end regions adjacent the face of each said piston in said Dead Center Spaced position providing a second fluid flow communication to and from opposite end portions of said cylinder chamber to the exterior of said mechanism; and timing means in force transmission relation to each said eccentric shaft to maintain said two eccentrics in each said cylinder assembly 180° out of rotary phase maintaining said piston opposing faces equidistant from said trunnion axis.

4. A reciprocating opposed piston mechanism of claim 3 wherein said cylinder and said pistons have a square cross section.

5. A reciprocating opposed piston mechanism of claim 1 wherein said timing means comprises a timing gear non-rotatably mounted to each said eccentric shaft and an idler gear rotatably mounted on said trunnion axis and engaging each said timing gear.

6. A reciprocating opposed piston mechanism of claim 5 additionally having a gear driven oil pump in meshed communication with one of said timing gears providing pressurized lubrication to working members of said mechanism.

7. A reciprocating opposed piston mechanism of claim 5 additionally having a flywheel non-rotatably attached to one of said eccentric shafts exterior to said block housing.

8. A reciprocating opposed piston mechanism of claim 3 having an even number of said cylinder assemblies mounted on said eccentric shafts with adjacent eccentrics in 180° rotary relation to each other.

9. A reciprocating opposed piston mechanism of claim 8 having two said cylinder assemblies.

10. A reciprocating opposed piston mechanism of claim 8 having four said cylinder assemblies.

11. A reciprocating opposed piston mechanism of claim 3 wherein said trunnion means comprise trunnions extending outwardly from opposite sides of said cylinder assembly, said trunnions rotatably mounted in bearings in said block housing.

12. A reciprocating opposed piston mechanism of claim 11 having a through port through the wall of said cylinder in the region adjacent the face of each said piston in a dead center spaced position, said ports providing fluid flow communication to and from opposite end portions of said cylinder to the exterior of said mechanism.

13. A reciprocating opposed piston mechanism of claim 3 wherein said spaced through ports through the wall of said cylinder are opened and closed by said oscillating action of said cylinder assembly.

14. A reciprocating opposed piston mechanism of claim 3 wherein said mechanism is a compressor wherein said first fluid flow is compressed fluid output and said second fluid flow is fluid input.

15. A reciprocating opposed piston mechanism of claim 3 wherein said mechanism is a prime mover wherein said first fluid flow is compressed fluid input and said second fluid flow is fluid output.

16. A reciprocating opposed piston mechanism of claim 3 wherein said mechanism is an internal combustion engine wherein said first fluid flow is fuel and said second fluid flow is exhaust.

17. In a reciprocating opposed piston mechanism having a block housing at least one cylinder assembly, said cylinder assembly comprising: a cylinder symmetrical about a central longitudinal cylinder axis and having a trunnion means extending outwardly at its midpoint along a trunnion axis which intersects said cylinder axis at a 90° angle, said trunnion means having a through port providing a first fluid flow communcation to and from the central portion of a cylinder chamber to the exterior of said mechanism, said cylinder mounted by said trunnion means to said block to oscillate in rotary relation about said trunnion axis, two opposing pistons having opposing faces equidistant from said trunnion axis and reciprocally mounted within said cylinder chamber, each of said pistons having an eccentric bearing mean mounted in its rear portion, an identical eccentric rotatably mounted in each said eccentric bearing means, each said eccentric fixedly mounted to an eccentric shaft, each said eccentric shaft rotatably mounted to said block and rotatable about an eccentric shaft axis parallel to and equally spaced in opposite directions from said trunnion axis, said eccentric shaft axes and said trunnion axis locatad on said cylinder axial center line when said pistons are in Dead Center Close and Dead Center Spaced positions, end through ports through the wall of said cylinder in opposite end regions adjacent the face of each said piston in said Dead Center Spaced position providing a second fluid flow communication to and from opposite end portions of said cylinder chamber to the exterior of said mechanism; and timing means in force transmission relation to each said eccentric shaft to maintain said two eccentrics in each said cylinder assembly 180° out of rotary phase maintaining said piston opposing faces equidistant from said trunnion axis.

18. A reciprocating opposed piston mechanism of claim 17 wherein said trunnion means comprise trunnions extending outwardly from opposite sides of said cylinder assembly, said trunnions rotatably mounted in bearings in said block housing.

19. A reciprocating opposed piston mechanism of claim 17 having an even number of said cylinder assemblies mounted on said eccentric shafts with adjacent eccentrics in 180° rotary relation to each other.

20. A reciprocating opposed piston mechanism of claim 17 wherein said spaced through ports through the wall of said cylinder are opened and closed by said oscillating action of said cylinder assembly.

21. A reciprocating opposed piston mechanism of claim 1 wherein said mechanism is a compressor wherein said first fluid flow is compressed fluid output and said second fluid flow is fluid input.

22. A reciprocating opposed piston mechanism of claims 17 wherein said mechanism is a prime mover wherein said first fluid flow is compressed fluid input and said second fluid flow is fluid output.

23. A reciprocating opposied piston mechanism of claim 17 wherein said mechanism is an internal combustion engine wherein said first fluid flow is fuel and said second fluid flow is exhaust.

24. A reciprocating opposed piston mechanism of claim 17 wherein said pistons and said cylinder chamber have a round cross section.

* * * * *